US011617447B2

(12) United States Patent
Clary

(10) Patent No.: US 11,617,447 B2
(45) Date of Patent: Apr. 4, 2023

(54) CANTILEVERED (FLOATING) FURNITURE SYSTEM, DEVICES AND ASSOCIATED METHODS

(71) Applicant: Jason Clary, Manhattan, MT (US)

(72) Inventor: Jason Clary, Manhattan, MT (US)

( * ) Notice: Subject to any disclaimer, the term of this patent is extended or adjusted under 35 U.S.C. 154(b) by 112 days.

(21) Appl. No.: 17/411,442

(22) Filed: Aug. 25, 2021

(65) Prior Publication Data

US 2022/0071401 A1 Mar. 10, 2022

Related U.S. Application Data

(60) Provisional application No. 63/076,609, filed on Sep. 10, 2020.

(51) Int. Cl.

| | |
|---|---|
| ***A47C 17/46*** | (2006.01) |
| ***A47C 17/38*** | (2006.01) |
| ***A47C 19/02*** | (2006.01) |
| ***A47B 5/00*** | (2006.01) |

(52) U.S. Cl.

CPC ..... *A47C 17/46* (2013.01); *A47B 5/00* (2013.01); *A47C 19/021* (2013.01); *A47C 17/38* (2013.01); *A47C 19/02* (2013.01)

(58) Field of Classification Search

CPC ..... A47C 17/46; A47C 17/38; A47C 19/021; A47C 19/02; A47C 19/005; A47B 5/00

USPC ..... 5/282.1, 279.1, 285, 200.1, 201

See application file for complete search history.

(56) References Cited

U.S. PATENT DOCUMENTS

| | | | | |
|---|---|---|---|---|
| 3,333,555 A * | 8/1967 | Kapnek | A47B 96/066 248/217.4 |
| 3,381,636 A * | 5/1968 | Saiberlich | A47B 57/46 108/42 |
| 4,058,860 A | 11/1977 | Daidone | |
| 4,167,145 A * | 9/1979 | Preslow | A47B 96/061 108/152 |
| 4,360,936 A | 11/1982 | Keller | |
| 4,381,715 A * | 5/1983 | Forman | A47B 96/066 403/329 |
| 4,452,336 A | 6/1984 | Sickler | |
| 4,480,327 A | 10/1984 | Vance | |

(Continued)

FOREIGN PATENT DOCUMENTS

DE 0418415 B1 2/1994

*Primary Examiner* — Robert G Santos

(74) *Attorney, Agent, or Firm* — Adam H. Owens; Paul Ditmyer; Granite Peak Law, PLLC

(57) ABSTRACT

The system, devices and method are for a cantilevered furniture (e.g., floating bed) installation including vertical frame reinforcements and frame brackets for securement to, or adjacent, a wall frame having top and bottom plates and vertically extending wall studs, and providing cantilevered support of a horizontally disposed frame. Horizontal frame supports or arms are coupled to support T-brackets which are installed where desired on the vertical frame reinforcements. The vertical frame reinforcements are secured where desired to the wall frame via top and bottom L-shaped frame brackets. The horizontal frame supports are longitudinally elongate and include support trusses extending and coupled therebetween to support an assembly (e.g., a bed assembly including at least a mattress with a platform or a box spring). For example, there may be six trusses for a parallel arrangement and eight trusses for a perpendicular arrangement.

20 Claims, 10 Drawing Sheets

(56) References Cited

U.S. PATENT DOCUMENTS

| | | | | |
|---|---|---|---|---|
| 4,783,863 | A | 11/1988 | Degen | |
| 4,837,877 | A | 6/1989 | Hamada et al. | |
| 4,868,939 | A | 9/1989 | Tagtow | |
| 4,898,355 | A * | 2/1990 | Steinway | A47B 96/062 248/248 |
| 4,958,391 | A | 9/1990 | Egeland | |
| 4,977,631 | A | 12/1990 | Bretz | |
| 5,020,169 | A | 6/1991 | Hamada et al. | |
| 5,377,787 | A | 1/1995 | Chabrier | |
| 5,461,735 | A | 10/1995 | Danton | |
| 5,483,707 | A | 1/1996 | Meyer et al. | |
| 5,502,850 | A | 4/1996 | Lyne, Jr. | |
| 5,842,586 | A | 12/1998 | Melby | |
| 2,943,714 | A | 8/1999 | Dignam | |
| 5,954,306 | A | 9/1999 | Hoover | |
| 6,164,610 | A * | 12/2000 | Santiago | A47B 96/022 211/90.01 |
| 6,557,190 | B2 | 5/2003 | Bailey | |
| 6,629,322 | B1 | 10/2003 | Monroe | |
| 6,651,273 | B2 | 11/2003 | Villsmeier | |
| 6,945,358 | B2 | 9/2005 | Albano | |
| 7,051,384 | B1 | 5/2006 | Guillot et al. | |
| 7,198,320 | B2 | 4/2007 | Rasmussen | |
| 7,559,097 | B2 | 7/2009 | Brun | |
| 8,082,859 | B2 * | 12/2011 | Sevack | A47B 96/066 248/250 |
| 8,136,183 | B1 | 3/2012 | Jannetides | |
| 8,595,989 | B1 | 12/2013 | Greene | |
| 9,163,415 | B2 * | 10/2015 | Nies | A47B 57/52 |
| 10,294,679 | B2 | 5/2019 | Muth | |
| 10,314,405 | B2 | 6/2019 | Grey | |
| 10,314,406 | B2 | 6/2019 | Grey | |
| 10,390,625 | B2 | 8/2019 | Grey | |
| 11,432,648 | B1 * | 9/2022 | Black | A47B 96/066 |
| 2007/0125738 | A1 * | 6/2007 | Sevack | A47B 96/066 211/187 |
| 2015/0182024 | A1 * | 7/2015 | Nies | E04F 19/005 108/42 |
| 2022/0071401 | A1 * | 3/2022 | Clary | A47C 17/38 |

* cited by examiner

CANTILEVERED (FLOATING) FURNITURE SYSTEM, DEVICES AND ASSOCIATED METHODS

RELATED APPLICATIONS

This application claims the benefit under 35 U.S.C. §119(e) of U.S. Provisional Patent Application Ser. No. 63/076,6009 titled CANTILEVERED (FLOATING) FURNITURE SYSTEM, DEVICES AND ASSOCIATED METHODS filed on Sep. 10, 2020, the entire contents of each of which are incorporated herein by reference.

FIELD OF THE INVENTION

The present invention relates in general to the construction and furniture fields, and in particular to a system, devices and associated methods for cantilevered or "floating" furniture (e.g. beds, tables, shelves, etc.).

BACKGROUND OF THE INVENTION

In general, there are various approaches to building or providing what is referred to as a "floating bed" design. The conventional approaches appear to provide a floating bed but most include the use of ceiling mounted cables, a pedestal or other ground support.

Other cantilevered or floating constructions may be directed to shelving units or tables, for example. U.S. Pat. No. 10,294,679 to Muth and titled "Support bracket for shelving and scaffolding" is directed to a support bracket for securement to a vertically extending wall stud and providing cantilevered support of a horizontally disposed plank, the support bracket incorporating a vertically oriented laterally adjustable stud gripping mechanism to enable securement and connection of the bracket where desired on studs of differing widths.

None of the conventional systems provide a true cantilevered furniture mounting system, without ground support, that can structurally withstand sheer forces over 1000 lbs or even up to 3000 lbs.

Thus, it may be desirable to provide a reliable, bolt-on cantilevered system and devices for relatively heavy furniture, such as floating beds, shelves, tables etc.

The above publications are identified herein in recognition of a duty of disclosure of related subject matter, which may be relevant under 37 CFR 1.56, and specifically incorporated herein by reference with respect to the conventional approaches and constructions taught therein.

This background section is intended to introduce the reader to various aspects of typical technology that may be related to various aspects or embodiments of the present invention, which are described and/or claimed below. This discussion is believed to be useful in providing the reader with background information to facilitate a better understanding of the various aspects and embodiments of the present invention. Accordingly, it should be understood that these statements are to be read in light of, and not as admissions of, the prior art.

SUMMARY OF THE INVENTION

It is an object of the present embodiments to provide a reliable, bolt-on cantilevered mounting system and devices for relatively heavy floating furniture such as beds, shelves, tables etc., without a need for ground support, that can structurally withstand sheer forces over 1000 lbs or even up to 3000 lbs or more.

This and other objects, advantages, and features in accordance with the present embodiments may be provided by a cantilevered mounting system including horizontal cantilever supports, trusses, and a support system having vertical spine reinforcements, various spacers, frame brackets and support brackets configured to be installed on a wall frame that includes wall studs.

The support system and devices are configured to be mounted to the wall frame prior to drywall or plastering. Additionally, the support system and devices may be installed after the wall is complete in a retro-fit approach, which may also increase the amount of labor needed. The support system includes the vertical spine reinforcements, spacers, frame brackets and support brackets. The horizontal cantilever supports, or arms, and multiple trusses extending between the horizontal cantilever supports, define a platform, e.g., a bed platform. An outer box may also be installed to surround the horizontal cantilever supports and multiple trusses extending therebetween.

An embodiment is directed to a cantilevered furniture mounting system configured to be mounted to a wall frame that includes wall studs that vertically extend between a top plate and a bottom plate, and support a piece of furniture (e.g., a bed or table). The cantilevered furniture mounting system includes at least two horizontal cantilever supports and a plurality of trusses spaced apart and extending between the at least two horizontal cantilever supports. A cantilever support system includes at least two vertical spine reinforcements with each being configured for colinear installation on a respective wall stud, a plurality of top frame L-brackets with each being configured to extend between the top plate and a respective wall stud to mount a top end of one of the vertical spine reinforcements to the respective wall stud, a plurality of bottom frame L-brackets with each being configured to extend between the bottom plate and a respective wall stud to mount a bottom end of one of the vertical spine reinforcements to the respective wall stud, and at least two support T-brackets with each being configured to be mounted on a portion of one of the vertical spine reinforcements between the top end and the bottom end thereof, with a trunk of the support T-bracket extending outwardly from the vertical spine reinforcement to mount a respective one of the horizontal cantilever supports thereon.

Additionally, and/or alternatively, the horizontal cantilever supports and the plurality of trusses extending therebetween define a platform.

Additionally, and/or alternatively, an outer box is configured to be installed to surround the horizontal cantilever supports and multiple trusses extending therebetween.

Additionally, and/or alternatively, the horizontal cantilever supports comprise metal horizontal cantilever supports having a box profile that slides onto the trunk of a respective support T-bracket.

Additionally, and/or alternatively, a distance between the horizontal cantilever supports is selectable by an installer based upon a size of the furniture piece to be supported.

Additionally, and/or alternatively, the horizontal cantilever supports are configured to support the furniture piece in an arrangement that is parallel to the wall frame or transverse to the wall frame.

Additionally, and/or alternatively, the vertical spine reinforcements comprise metal vertical spine reinforcements having a C-shaped profile. Spine spacers are configured to be positioned within an interior space of the metal vertical spine reinforcements adjacent the top and bottom frame L-brackets to define a solid stack and prevent distortion of the vertical spine reinforcements.

Additionally, and/or alternatively, the cantilevered furniture mounting system includes spine reinforcement spacers, wherein the respective vertical spine reinforcement and the respective spine reinforcement spacer together sandwich the corresponding wall stud, the spine spacer, and the frame L-bracket, and are held together via lag bolts.

Another embodiment is directed to a cantilevered furniture mounting system configured to be mounted to a wall frame that includes wall studs, and support a piece of furniture (e.g., a bed or table). The cantilevered furniture mounting system includes two horizontal cantilever supports, and a plurality of trusses spaced apart and extending between the two horizontal cantilever supports. A cantilever support system includes two vertical spine reinforcements with each being configured for colinear installation on a respective wall stud, two top frame brackets with each being configured to mount a top end of one of the vertical spine reinforcements to the respective wall stud, two bottom frame brackets with each being configured to mount a bottom end of one of the vertical spine reinforcements to the respective wall stud, and two support brackets with each being configured to be mounted on a respective vertical spine reinforcement, with a trunk of the support bracket extending outwardly from the vertical spine reinforcement to mount a respective one of the horizontal cantilever supports thereon.

Additionally, and/or alternatively, the horizontal cantilever supports and plurality of trusses extending therebetween define a platform.

Additionally, and/or alternatively, the horizontal cantilever supports comprise metal horizontal cantilever supports having a box profile that slides onto the trunk of a respective support bracket.

Additionally, and/or alternatively, the vertical spine reinforcements comprise metal vertical spine reinforcements having a C-shaped profile. Spine spacers are configured to be positioned within an interior space of the metal vertical spine reinforcements adjacent the brackets to define a solid stack and prevent distortion of the vertical spine reinforcements.

Additionally, and/or alternatively, the system includes spine reinforcement spacers, wherein the respective vertical spine reinforcement and the respective spine reinforcement spacer together sandwich the corresponding wall stud, the spine spacer, and the frame bracket, and are held together via lag bolts.

Another embodiment is directed to a cantilevered bed mounting system to be mounted to a wall frame that includes drywall positioned on wall studs that vertically extend between a top plate and a bottom plate and support a bed. The cantilevered bed mounting system includes at least two horizontal cantilever supports, and a plurality of trusses spaced apart and extending between the at least two horizontal cantilever supports. A cantilever support system includes at least two vertical spine reinforcements with each being colinearly installed on a respective wall stud, a plurality of top frame L-brackets with each extending between the top plate and a respective wall stud to mount a top end of one of the vertical spine reinforcements to the respective wall stud, a plurality of bottom frame L-brackets with each extending between the bottom plate and a respective wall stud to mount a bottom end of one of the vertical spine reinforcements to the respective wall stud, and at least two support T-brackets with each being mounted on a portion of one of the vertical spine reinforcements between the top end and the bottom end thereof, with a trunk of the support T-bracket extending outwardly from the vertical spine reinforcement, through the drywall, to mount a respective one of the horizontal cantilever supports thereon. An outer box surrounds the horizontal cantilever supports and multiple trusses extending therebetween to define a bed platform.

Additionally, and/or alternatively, the horizontal cantilever supports comprise metal horizontal cantilever supports having a box profile that slides onto the trunk of a respective support T-bracket.

Additionally, and/or alternatively, the horizontal cantilever supports are configured to support the bed in an arrangement that is parallel to the wall frame or transverse to the wall frame.

Additionally, and/or alternatively, the vertical spine reinforcements comprise metal vertical spine reinforcements having a C-shaped profile. Spine spacers are configured to be positioned within an interior space of the metal vertical spine reinforcements adjacent the top and bottom frame L-brackets to define a solid stack and prevent distortion of the vertical spine reinforcements.

Additionally, and/or alternatively, the system includes spine reinforcement spacers, wherein the respective vertical spine reinforcement and the respective spine reinforcement spacer together sandwich the corresponding wall stud, the spine spacer and the frame L-bracket, and are held together via lag bolts.

DETAILED DESCRIPTION OF THE PREFERRED EMBODIMENTS

Figure 1:
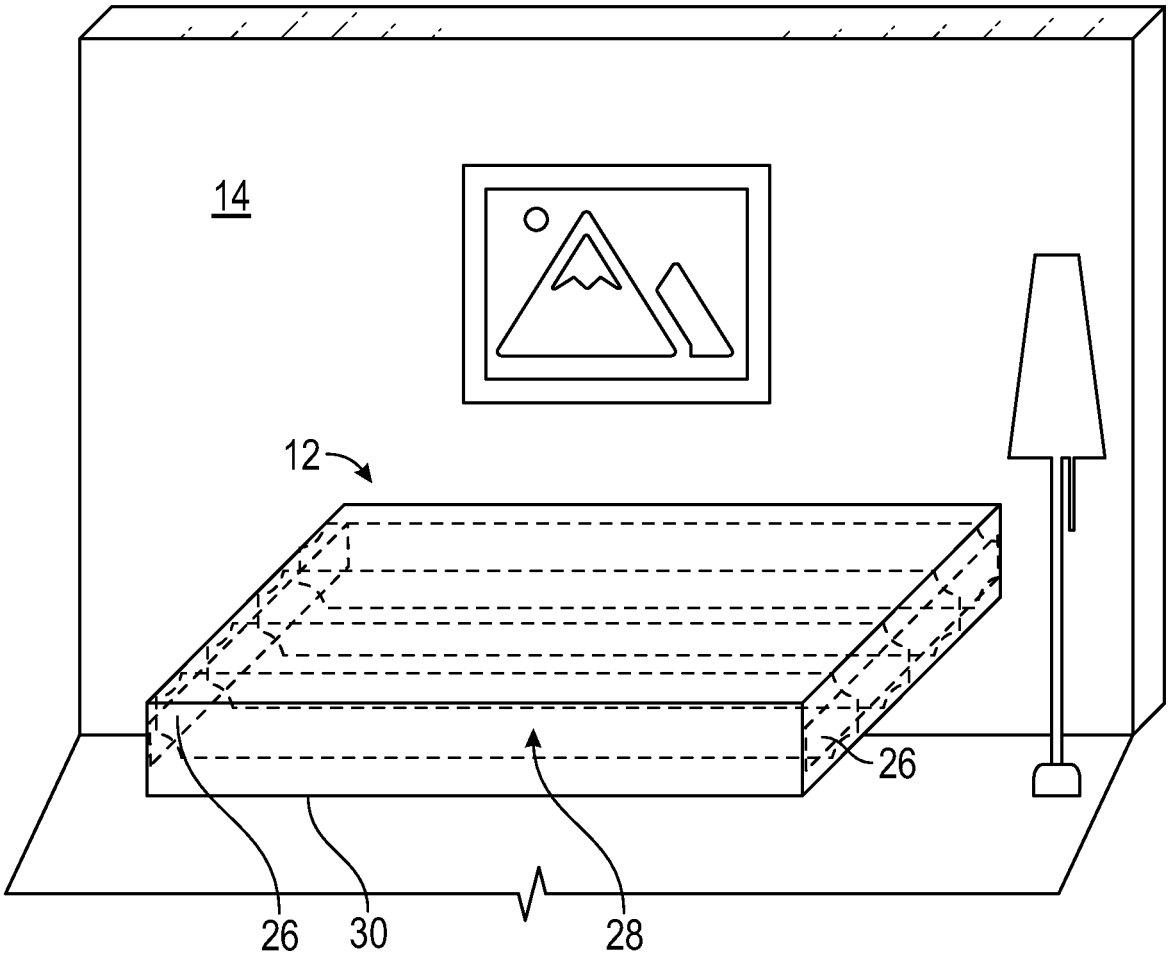
FIG. 1 is a schematic perspective view illustrating an installed floating bed system according to an embodiment of the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

Furniture refers to movable or immovable objects intended to support various human activities such as sitting (e.g., chairs, stools, and sofas), eating (tables), and sleeping (e.g., beds). Furniture is also used to hold objects at a convenient height for work (as horizontal surfaces above the ground, such as tables and desks), or to store things (e.g., cupboards and shelves).

With the present approach, a stronger, more reliable, accurate and precise floating furniture installation is provided. This may also reduce the materials needed for a floating furniture design. Also, the labor times for installers may be reduced.

Referring to the drawings FIGS. 1-11, the approach including a system, devices and method of the present invention is described and illustrated. The example embodiments are best understood from the following detailed description when read with the accompanying drawing figures. Dimensions may be arbitrarily increased or decreased for clarity of discussion. Measurements indicated in the drawing figures are examples for typical framed walls and standard size beds (e.g., twin, full, queen, king). Other measurements are contemplated.

Figure 2A:
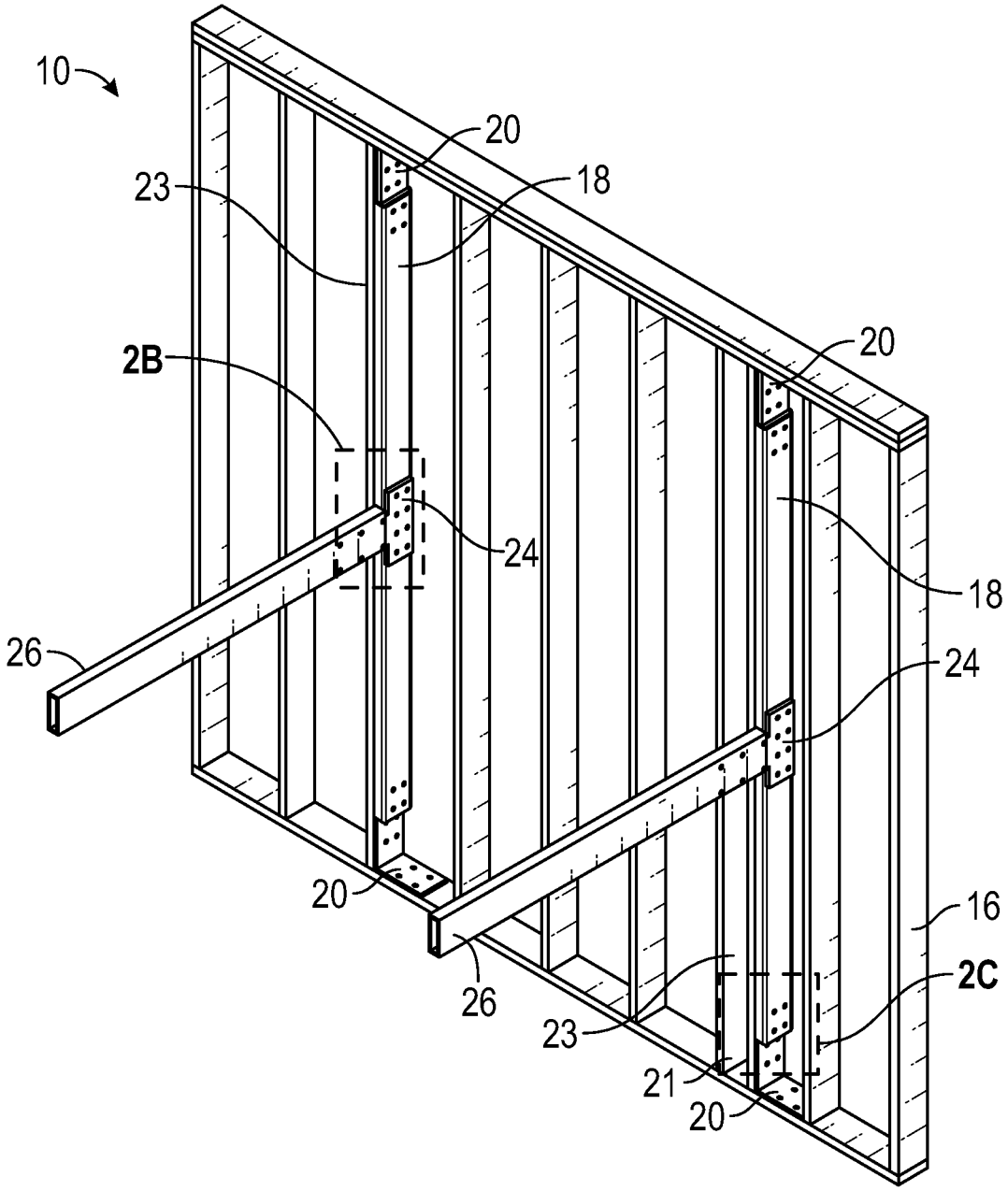
FIG. 2A is a schematic perspective view illustrating various components of the cantilevered mounting system used in FIG. 1 and including horizontal cantilever supports, vertical spine reinforcements, frame brackets and support brackets installed on a wall frame.

An example embodiment of the cantilevered mounting system 10, will be described. FIG. 1 is a schematic perspective view illustrating an installed floating bed 12 using the cantilevered mounting system 10 according to an embodiment of the present invention. The floating bed 12 extends from a wall 14 at a selected height. FIG. 2A is a schematic perspective view illustrating various components of the cantilevered mounting system 10 including the support system and devices that are configured to be mounted to the wall frame 16 prior to drywall or plastering. The wall frame 16 includes vertical studs extending between a top plate and a bottom plate, as would be appreciated by those skilled in the art.

Figure 2B:
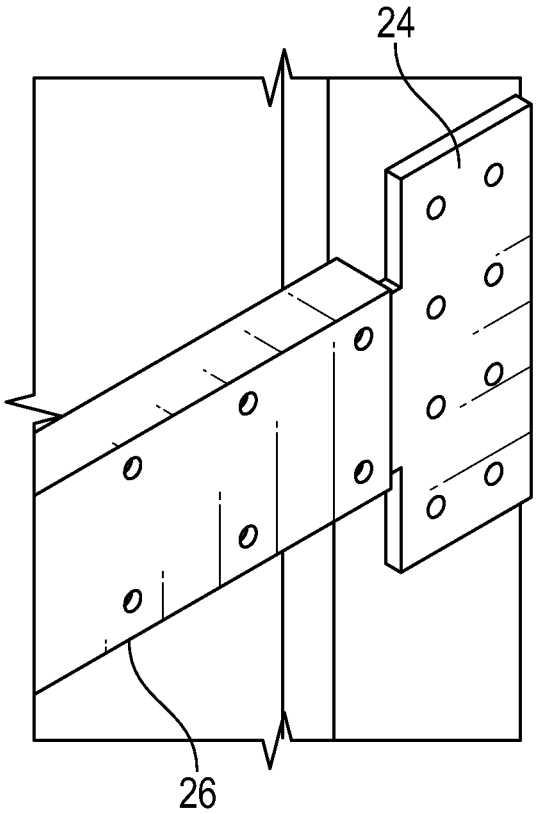
FIG. 2B is a more detailed view of the support T-bracket of FIG. 2A.

The support system includes vertical spine reinforcements 18, frame L-brackets 20, various spacers 22 and support T-brackets 24 installed on the wall frame 16. FIG. 2B is a more detailed view of the support T-bracket 24 and associated horizontal cantilever support 26 illustrating the pre-drilled holes for lag screws or bolts 27 and button screws. The horizontal cantilever support 26 may be slid onto the trunk (extending from the frame 16 and through the drywall of the wall 14) of the T-bracket 24 after drywall. As discussed, the support system may be retrofitted to a room with finished walls, for example, by creating a false wall to hide the support system L-brackets 20 and vertical spine reinforcements 18.

Figure 2C:
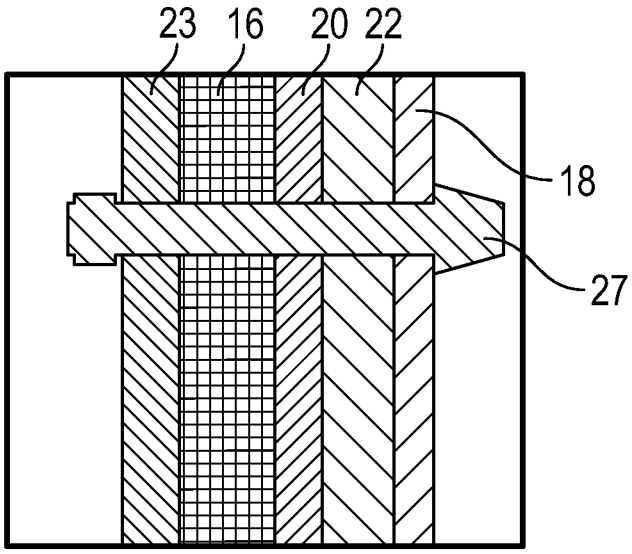
FIG. 2C is an enlarged cross-sectional view of the joint including the spine reinforcement spacer, stud, frame L-bracket, spacer, and vertical spine reinforcement.
Figure 3A:
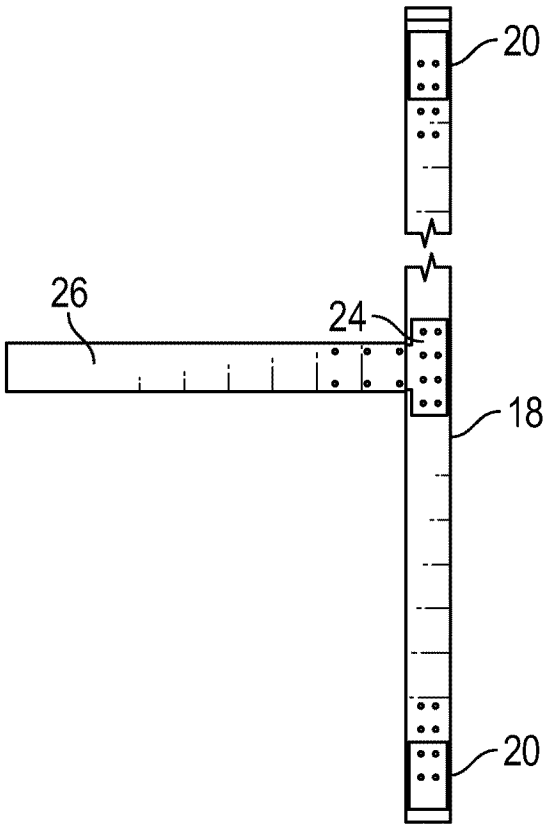
FIGS. 3A-3D are various detailed views of the horizontal cantilever supports, vertical spine reinforcements, frame brackets and support brackets of the cantilevered mounting system of FIG. 2A.
Figure 3B:
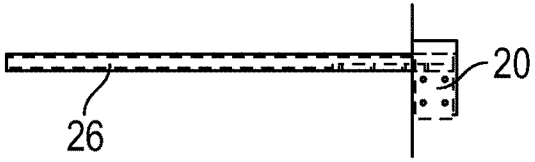
Figure 3C:
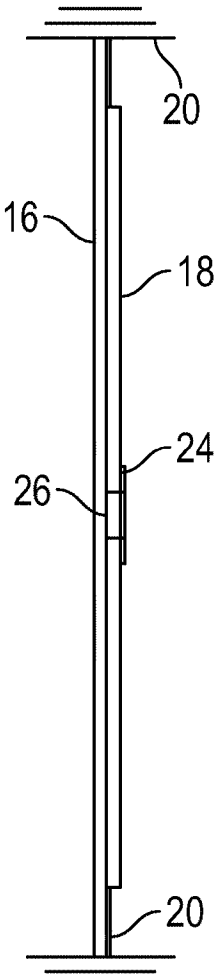
Figure 3D:
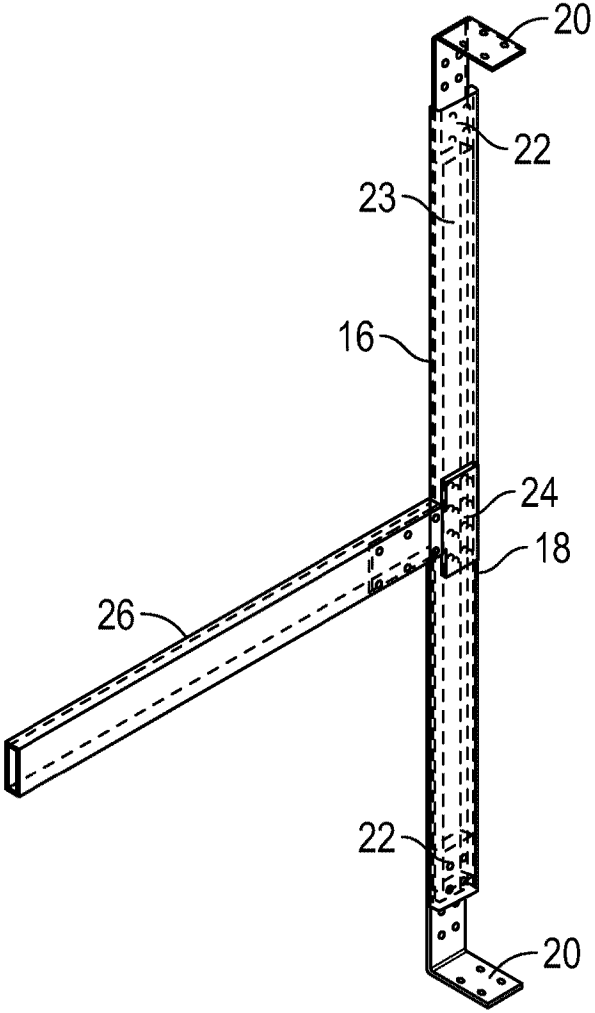

FIG. 2C is an enlarged cross-sectional view of the joint 21 including the spine reinforcement spacer 23, stud 16, frame L-bracket 20, spacer 22, and vertical spine reinforcement 18. As illustrated, the vertical spine reinforcement 18 and the spine reinforcement spacer 23 together sandwich the stud 16, the spacer 22, and the L-bracket 20, and are held together via lag bolts 27, for example.

The cantilevered mounting system 10 further includes the horizontal frame supports 26, or arms, and multiple trusses 28 extending between the horizontal cantilever supports 26. An outer box 30 may also be installed to surround the horizontal cantilever supports 26 and multiple trusses 28 extending therebetween, to define a platform, e.g., a bed platform as shown in FIG. 1. The outer box 30 may be wood, synthetic, metal, or any other desired structural box material.

FIGS. 3A-3D include various more detailed views of the relationships between the horizontal cantilever support 26, vertical spine reinforcement 18, frame L-brackets 20 and support T-brackets 24 of the cantilevered mounting system 10. The installer can select the height, and any positive load angle (e.g., between 1-3°) of the support T-bracket 24 when drilling and bolting the head of the support T-bracket 24 to the vertical spine reinforcement 18. A special jig may be used during this step of the installation. The T-bracket 24 holes may be pre-drilled, or the T-bracket 24 may be pre-cut, to provide the desired positive load angle when it is then mounted to the vertical spine reinforcement 18.

Figure 4C:
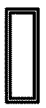
FIGS. 4A-4C are various views of the horizontal cantilever support of the cantilevered mounting system of FIG. 2A.
Figure 4B:
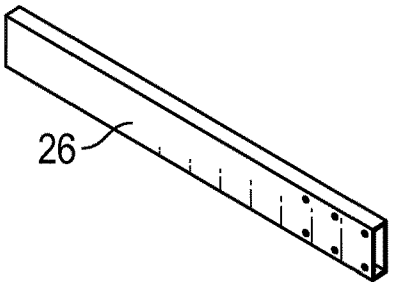
Figure 4A:
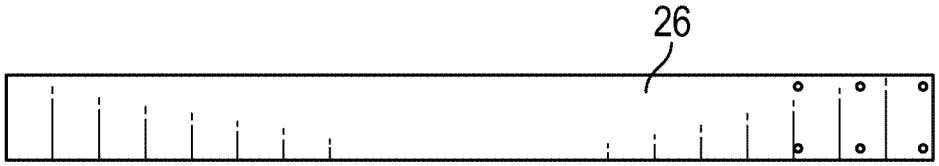

FIGS. 4A-4C include various views of the horizontal cantilever support 26 of the cantilevered mounting system 10. The horizontal cantilever support 26 may be fabricated from ¼" aluminum in a box profile, e.g., 6"×2" for a queen bed. The horizontal cantilever support 26, or arm, slides onto the trunk of the support T-bracket 24 after drywall installation. The trusses 28 and outer box 30 may then be installed onto the horizontal cantilever supports 26. The width between the horizontal cantilever supports 26 will be selected by the installer in view of the selected size of the furniture, e.g., bed or table. As such, beds may be installed parallel to the wall 14 or in an opposed arrangement where the length is transverse to the wall 14.

Figure 6B:
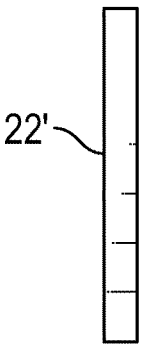
FIGS. 6A and 6B are various views of another embodiment of a spine spacer of the cantilevered mounting system of FIG. 2A.
Figure 6A:
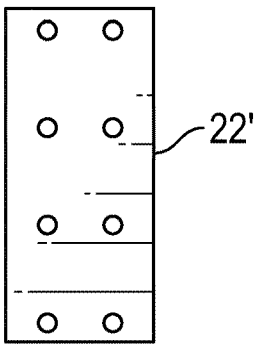
Figure 5B:
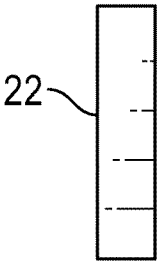
FIGS. 5A and 5B are various views of a spine spacer of the cantilevered mounting system of FIG. 2A.
Figure 5A:
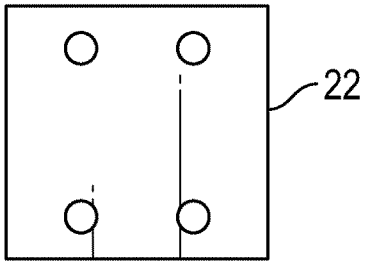
Figure 7C:
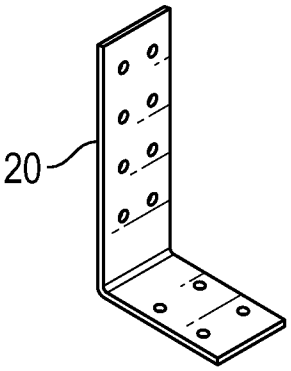
FIGS. 7A-7E are various views of the top/bottom frame L-brackets of the cantilevered mounting system of FIG. 2A.
Figure 7B:
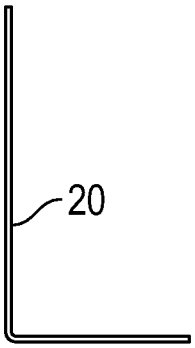
Figure 7A:
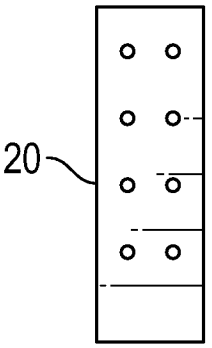
Figure 7E:
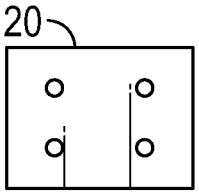
Figure 7D:
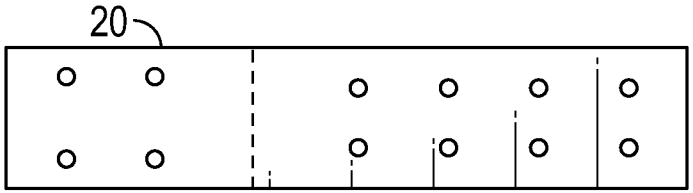
Figure 8B:
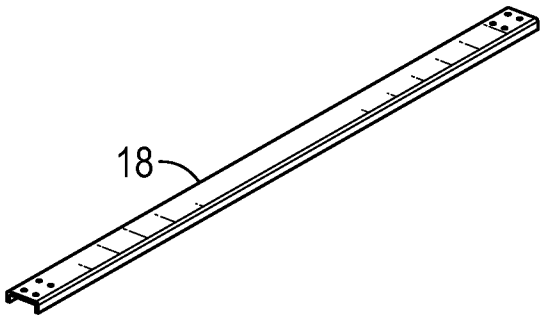
FIGS. 8A-8D are various views of the vertical spine reinforcement of the cantilevered mounting system of FIG. 2A.
Figure 8D:
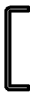
Figure 8A:
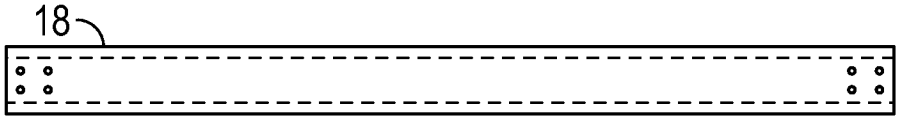
Figure 8C:
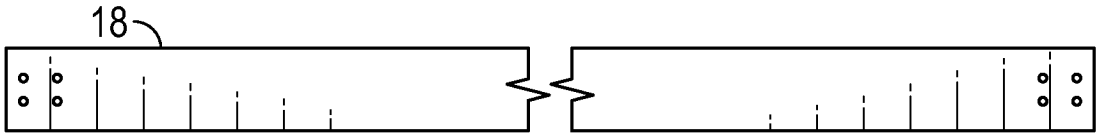

FIGS. 5A and 5B include various views of a spine spacer 22 of the cantilevered mounting system 10. FIGS. 6A and 6B include various views of another embodiment of a spine spacer 22' of the cantilevered mounting system 10. The spine spacer 22' may be about twice the length, or more, of spine spacer 22. Such spacers 22/22' may be fabricated from 1" aluminum and are positioned within the interior space of the vertical spine reinforcement 18 (e.g., with C-shaped profile)

to create a solid stack for the lag bolts 27 and prevent any distortion of the vertical spine reinforcement 18 during installation and/or operation.

FIGS. 7A-7E include various views of the top/bottom frame L-brackets 20 of the cantilevered mounting system 10. The frame L-brackets 20 may be fabricated of ¼" aluminum plate, for example, and may include various bolt patterns on the back portion to provide the installer with flexible installation of the vertical spine reinforcement 18 thereon.

FIGS. 8A-8D include various views of the vertical spine reinforcement 18 of the cantilevered mounting system 10. The vertical spine reinforcements 18 may be fabricated of ¼" aluminum plate, for example, and may include a C-shape profile, as illustrated, to enhance structural integrity thereof.

Figure 9B:
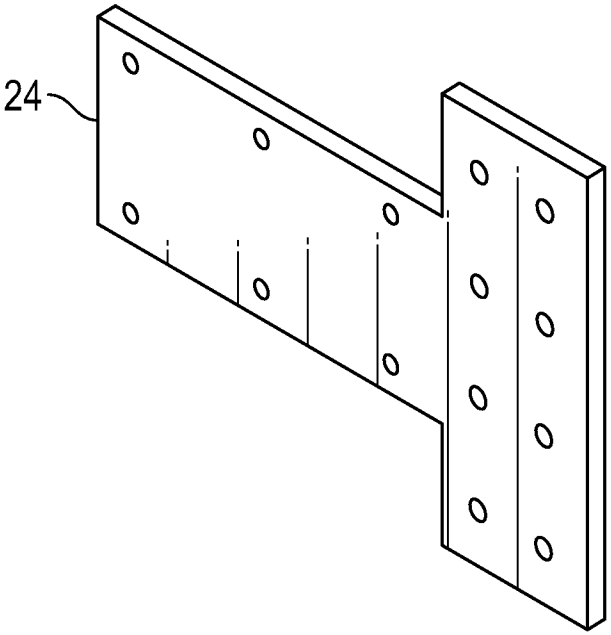
FIGS. 9A-9C are various views of an embodiment of a floating furniture T-bracket of the cantilevered mounting system of FIG. 2A.
Figure 9C:
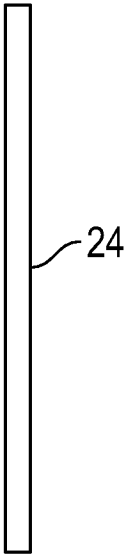
Figure 9A:
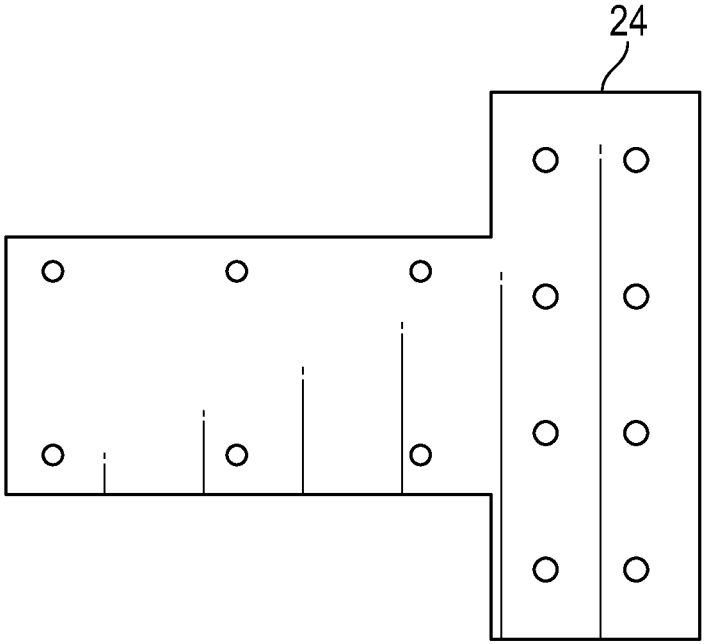

FIGS. 9A-9C include various views of an embodiment of a support T-bracket 24 of the cantilevered mounting system 10. The support T-brackets 24 may be fabricated of ½" stainless steel plate, for example, and may include various bolt patterns and trunk lengths in relation to the selected furniture size and desired weight support.

Figure 10A:
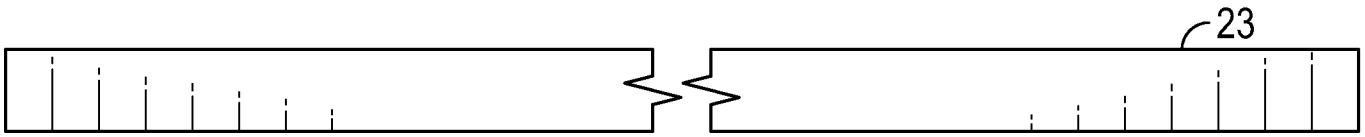
FIGS. 10A-10C are various views of an embodiment of a spine reinforcement spacer of the cantilevered mounting system of FIG. 2A.
Figure 10B:
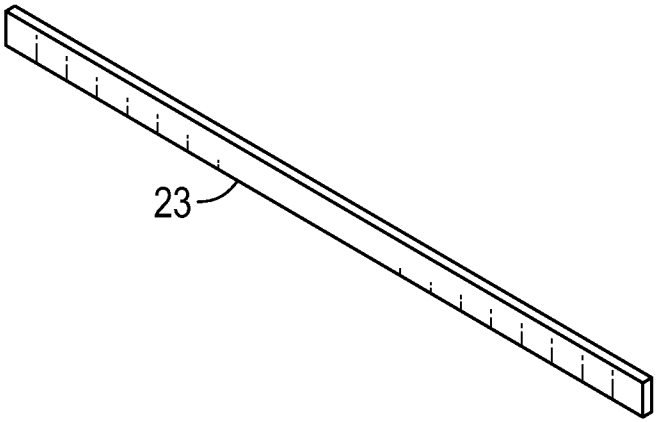
Figure 10C:
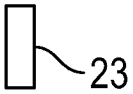

FIGS. 10A-10C include various views of an embodiment of a spine reinforcement spacer 23 of the cantilevered mounting system 10. The spine reinforcement spacer 23 may be an engineered wood product (e.g., 1¼"×4") such as Laminated veneer lumber (LVL). LVL uses multiple layers of thin wood assembled with adhesives. It is typically used for headers, beams, rimboard, and edge-forming material. LVL offers several advantages over typical milled lumber as it is made in a factory under controlled specifications, it is stronger, straighter, and more uniform. Due to its composite nature, it is much less likely than conventional lumber to warp, twist, bow, or shrink. LVL is a type of structural composite lumber, comparable to Glued laminated timber (Gluelam) but with a higher allowable stress.

Figure 11A:
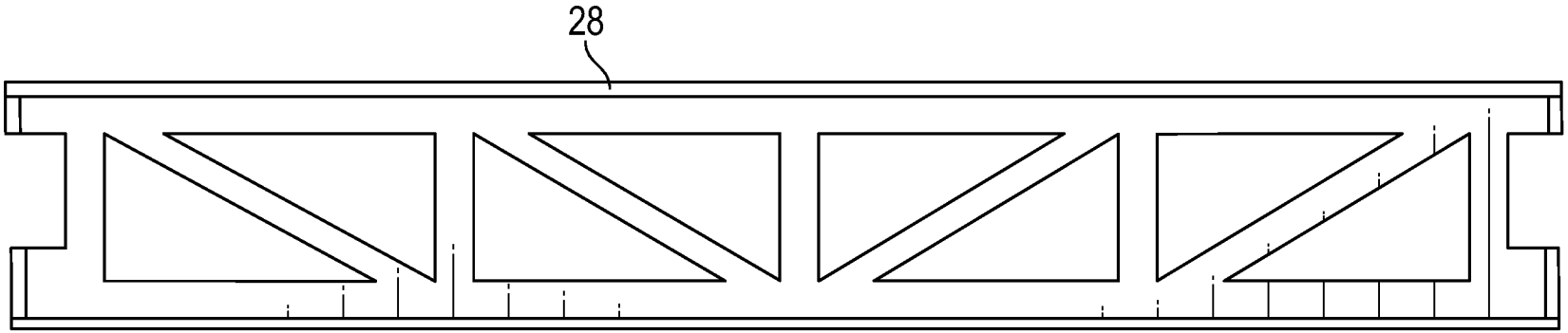
FIGS. 11A and 11B are side views of furniture (e.g. bed) support trusses of the cantilevered mounting system illustrated in FIG. 1.
Figure 11B:
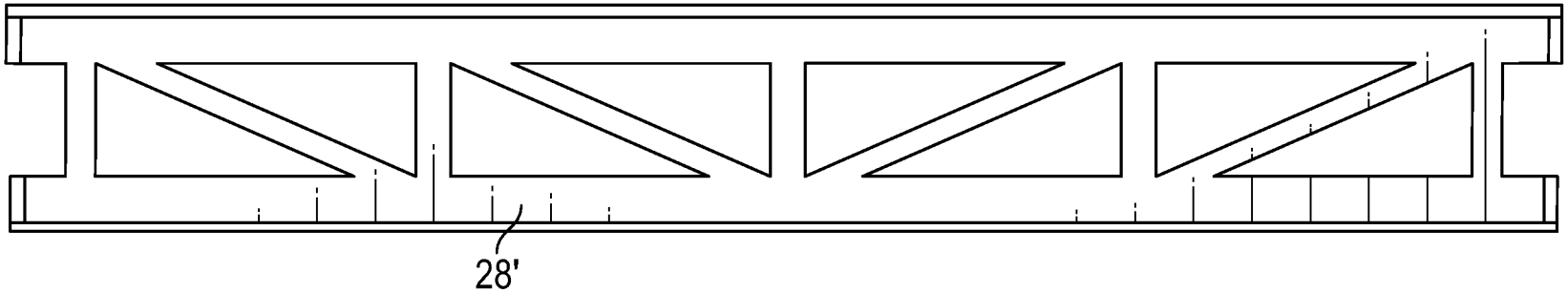

FIGS. 11A and 11B are side views of the support trusses 28, 28' of the cantilevered mounting system 10. The support trusses 28, 28' extend between the horizontal cantilever supports 26 and couple thereto via the end notches. The outer box 30 is preferably secured (e.g., screwed) to the ends of the support trusses 28, 28'. Any number of support trusses 28, 28' may be used in view of the desired weight support and stability. For example, six support trusses 28 may be used for a parallel queen bed platform, or eight support trusses 28' may be used for an opposed king bed platform. The support trusses 28, 28' are preferably Pratt trusses, but other trusses are contemplated. A Pratt truss includes vertical members and diagonals that slope down towards the center, the opposite of the Howe truss. The interior diagonals are under tension under balanced loading and vertical elements under compression.

The trusses 28, 28' may be modified to create a space for electronics within the outer box 30 between the horizontal cantilever supports 26. Such electronics may include a television and associated automated retraction system that selectively positions the television vertically at the foot of the bed, for example.

Accordingly, the cantilevered mounting system 10 of the present embodiments provides a stronger, more reliable, accurate and precise floating furniture installation. For example, a king bed platform weighing 1000-2000 lbs (with lighting and associated electronics) can support 1000-2000 lbs of additional weight from humans, etc. The cantilevered mounting system 10 is a bolt-together system that does not require any welding by the installer.

The present invention may have also been described, at least in part, in terms of one or more embodiments. An embodiment of the present invention is used herein to illustrate the present invention, an aspect thereof, a feature thereof, a concept thereof, and/or an example thereof. A physical embodiment of an apparatus, an article of manufacture, a machine, and/or of a process that embodies the present invention may include one or more of the aspects, features, concepts, examples, etc. described with reference to one or more of the embodiments discussed herein. Further, from figure to figure, the embodiments may incorporate the same or similarly named functions, steps, modules, etc. that may use the same or different reference numbers and, as such, the functions, steps, modules, etc. may be the same or similar functions, steps, modules, etc. or different ones.

The above description provides specific details, such as material types and processing conditions to provide a thorough description of example embodiments. However, a person of ordinary skill in the art would understand that the embodiments may be practiced without using these specific details.

Some of the illustrative aspects of the present invention may be advantageous in solving the problems herein described and other problems not discussed which are discoverable by a skilled artisan. While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced items. Thus, the scope of the invention should be determined by the eventual claims and their legal equivalents, and not by the examples given.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

The invention claimed is:

1. A cantilevered furniture mounting system configured to be mounted to a wall frame that includes wall studs that vertically extend between a top plate and a bottom plate, and support a piece of furniture, the cantilevered furniture mounting system comprising:

at least two horizontal cantilever supports;

a plurality of trusses spaced apart and extending between the at least two horizontal cantilever supports; and a cantilever support system including at least two vertical spine reinforcements, each vertical spine reinforcement being configured for colinear installation on a respective wall stud, a plurality of top frame L-brackets, each top frame L-bracket being configured to extend between the top plate and a respective wall stud to mount a top end of one of the vertical spine reinforcements to the respective wall stud, a plurality of bottom frame L-brackets, each bottom frame L-bracket being configured to extend between the bottom plate and a respective wall stud to mount a bottom end of one of the vertical spine reinforcements to the respective wall stud, and at least two support T-brackets, each support T-bracket being configured to be mounted on a portion of one of the vertical spine reinforcements between the top end and the bottom end thereof, with a trunk of the support T-bracket extending outwardly from the vertical spine reinforcement to mount a respective one of the horizontal cantilever supports thereon.

2. The cantilevered furniture mounting system of claim 1, wherein the horizontal cantilever supports and the plurality of trusses extending therebetween define a platform.

3. The cantilevered furniture mounting system of claim 2, further comprising an outer box configured to be installed to surround the horizontal cantilever supports and multiple trusses extending therebetween.

4. The cantilevered furniture mounting system of claim 1, wherein the horizontal cantilever supports comprise metal horizontal cantilever supports having a box profile that slides onto the trunk of a respective support T-bracket.

5. The cantilevered furniture mounting system of claim 1, wherein a distance between the horizontal cantilever supports is selectable by an installer based upon a size of the furniture piece to be supported.

6. The cantilevered furniture mounting system of claim 5, wherein the furniture piece is one of a bed and a table.

7. The cantilevered furniture mounting system of claim 6, wherein the horizontal cantilever supports are configured to support the furniture piece in an arrangement that is parallel to the wall frame or transverse to the wall frame.

8. The cantilevered furniture mounting system of claim 1, wherein the vertical spine reinforcements comprise metal vertical spine reinforcements having a C-shaped profile; and further comprising spine spacers configured to be positioned within an interior space of the metal vertical spine reinforcements adjacent the top and bottom frame L-brackets to define a solid stack and prevent distortion of the vertical spine reinforcements.

9. The cantilevered furniture mounting system of claim 8, further comprising spine reinforcement spacers, wherein the respective vertical spine reinforcement and the respective spine reinforcement spacer together sandwich the corresponding wall stud, the spine spacer, and the frame L-bracket, and are held together via lag bolts.

10. A cantilevered furniture mounting system configured to be mounted to a wall frame that includes wall studs, and support a piece of furniture, the cantilevered furniture mounting system comprising:

two horizontal cantilever supports; and a cantilever support system including two vertical spine reinforcements, each vertical spine reinforcement being configured for colinear installation on a respective wall stud, two top frame brackets, each top frame bracket being configured to mount a top end of one of the vertical spine reinforcements to the respective wall stud, two bottom frame brackets, each bottom frame bracket being configured to mount a bottom end of one of the vertical spine reinforcements to the respective wall stud, and two support brackets, each support bracket being configured to be mounted on a respective vertical spine reinforcement, with a trunk of the support bracket extending outwardly from the vertical spine reinforcement to mount a respective one of the horizontal cantilever supports thereon.

11. The cantilevered furniture mounting system of claim 10, further comprising a plurality of trusses spaced apart and extending between the two horizontal cantilever supports to define a platform.

12. The cantilevered furniture mounting system of claim 10, wherein the horizontal cantilever supports comprise metal horizontal cantilever supports having a box profile that slides onto the trunk of a respective support bracket.

13. The cantilevered furniture mounting system of claim 10, wherein the furniture piece is one of a bed and a table.

14. The cantilevered furniture mounting system of claim 10, wherein the vertical spine reinforcements comprise metal vertical spine reinforcements having a C-shaped profile; and further comprising spine spacers configured to be positioned within an interior space of the metal vertical spine reinforcements adjacent the brackets to define a solid stack and prevent distortion of the vertical spine reinforcements.

15. The cantilevered furniture mounting system of claim 14, further comprising spine reinforcement spacers, wherein the respective vertical spine reinforcement and the respective spine reinforcement spacer together sandwich the corresponding wall stud, the spine spacer, and the frame bracket, and are held together via lag bolts.

16. A cantilevered bed mounting system to be mounted to a wall frame that includes drywall positioned on wall studs that vertically extend between a top plate and a bottom plate, and support a bed, the cantilevered bed mounting system comprising:

at least two horizontal cantilever supports;

a plurality of trusses spaced apart and extending between the at least two horizontal cantilever supports; and a cantilever support system including at least two vertical spine reinforcements, each vertical spine reinforcement being colinearly installed on a respective wall stud, a plurality of top frame L-brackets, each top frame L-bracket extending between the top plate and a respective wall stud to mount a top end of one of the vertical spine reinforcements to the respective wall stud, a plurality of bottom frame L-brackets, each bottom frame L-bracket extending between the bottom plate and a respective wall stud to mount a bottom end of one of the vertical spine reinforcements to the respective wall stud, and at least two support T-brackets, each support T-bracket being mounted on a portion of one of the vertical spine reinforcements between the top end and the bottom end thereof, with a trunk of the support T-bracket extending outwardly from the vertical spine reinforcement, through the drywall, to mount a respective one of the horizontal cantilever supports thereon; and an outer box surrounding the horizontal cantilever supports and multiple trusses extending therebetween to define a bed platform.

17. The cantilevered bed mounting system of claim 16, wherein the horizontal cantilever supports comprise metal horizontal cantilever supports having a box profile that slides onto the trunk of a respective support T-bracket.

18. The cantilevered bed mounting system of claim 16, wherein the horizontal cantilever supports are configured to support the bed in an arrangement that is parallel to the wall frame or transverse to the wall frame.

19. The cantilevered bed mounting system of claim 16, wherein the vertical spine reinforcements comprise metal vertical spine reinforcements having a C-shaped profile; and further comprising spine spacers configured to be positioned within an interior space of the metal vertical spine reinforcements adjacent the top and bottom frame L-brackets to define a solid stack and prevent distortion of the vertical spine reinforcements.

20. The cantilevered bed mounting system of claim 19, further comprising spine reinforcement spacers, wherein the respective vertical spine reinforcement and the respective spine reinforcement spacer together sandwich the corresponding wall stud, the spine spacer, and the frame L-bracket, and are held together via lag bolts.

* * * * *